United States Patent [19]

Tong

[11] Patent Number: 5,029,702

[45] Date of Patent: Jul. 9, 1991

[54] SKATEBOARD CARTON

[75] Inventor: Wai-Lop Tong, Kowloon, Hong Kong

[73] Assignee: Dynacraft Industries, Inc., Ashland, Mass.

[21] Appl. No.: 584,198

[22] Filed: Sep. 18, 1990

[51] Int. Cl.[5] ..... B65D 85/00; B65D 25/04; B65D 25/54; B65D 21/00

[52] U.S. Cl. ..... 206/315.1; 206/45.31; 206/45.34; 206/507; 206/491

[58] Field of Search ..... 206/491, 45.31, 45.34, 206/315.1, 507, 491

[56] References Cited

U.S. PATENT DOCUMENTS 2,294,965 9/1942 Davidson ..... 206/491

*Primary Examiner*—William I. Price

*Attorney, Agent, or Firm*—Laff, Whitesel, Conte & Saret

[57] ABSTRACT

A skateboard box is made from two blanks which fold, mutually capturing each other, and join to form a compound box. The boxes are generally trapezoidal in cross-section and nest when two boxes are inverted relative to each other. When nested, the wheels of one skateboard fit into a compartment in the box of the other skateboard, thereby making a compact shipping unit. A window in the box displays graphics on the skateboard.

12 Claims, 3 Drawing Sheets

SKATEBOARD CARTON

This invention relates to packaging, cartons, boxes, and the like, and more particularly to cartons or boxes for skateboards.

Skateboards are well known devices comprising a board with four wheels on or about the corners thereof. These wheels make it awkward and difficult to stack, ship, and store the skateboards. It is often desirable to completely enclose a skateboard in its own individual box so that smooth box surfaces may rest against each other. However, use of such individual boxes would be very inefficient, since the board and wheels require a substantially deeper box than the board alone, resulting in a box which is primarily occupied by dead air space rather than by product. Any such shipment of dead air space is always expensive. Therefore, it would be better if two skateboards could be nested in a single box so that they mutually utilized most of the space around their wheels, thus greatly reducing the shipment of dead air space. If two skateboards are packed in each box, however, it becomes expensive to unpack the boxes at the point of purchase. Since most end customers do not buy two skateboards at a time, it would be better to give the customer a box with a single skateboard which he can carry home and unpack for himself.

Another consideration is the protection of the skateboards in the area of a store where retail sales occur. If skateboards are simply unpacked and placed on an accessible display, children are likely to try them in the store, bumping into customers, hurting themselves, and damaging merchandise, counters, and the like. If the skateboards are kept behind counters or in other places which are unaccessible to the customers, sales may be discouraged. Furthermore, unpacked and unprotected skateboards may be damaged, dropped, scratched, etc. while on display pending sales.

Yet another consideration is the attractiveness of the product to a customer. If the product is concealed in a package or is packaged in an unattractive manner, it will not attract the kind of sales which an attractive display generates. This is especially true when the sales are directed to the age group which is influenced by childhood fantasy. For example, a product is much more acceptable to this group if it carries graphics identified with a super hero, or a rocket, or the like. Hence, to attract a child, a box should display the graphics on the product in an attention-getting manner.

Accordingly, an object of this invention is to provide a box for products which can be nested during shipment and storage and which minimizes dead air space. Here, an object is to provide such boxes which do not have to be unpacked at the point of purchase. In particular, an object is to provide a box which displays a product in an attractive manner at the point of purchase.

Another object of the invention is to provide a box for a skateboard. In particular, an object is to provide a box which displays a skateboard in an attractive manner while preventing it from being damaged while in shipment or storage and continuing up to the time of purchase. Here, an object is to display graphics on both sides of the skateboard.

In keeping with an aspect of the invention, these and other objects are accomplished by a box which holds the skateboard while exposing the wheels. One end of the box is shaped to support an opposite end of a similar box which is positioned so that the exposed wheels of the two skateboards are nested, even while they remain in their respective boxes. The back of the box has a window formed therein to expose graphics on one side of the skateboard. The other side of the box (i.e., where the wheels are located) is open to expose virtually all of the surface of the board and any graphics thereon.

A preferred embodiment of the invention is shown in the attached drawings wherein.

Figure 1:
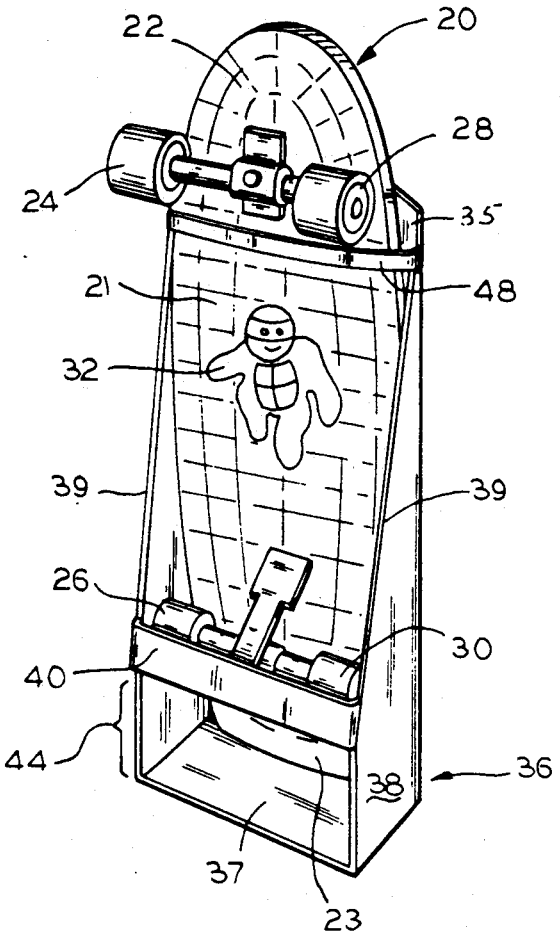
FIG. 1 is a perspective view of one side of the inventive box with the skateboard wheels and the graphics on the underside of the skateboard exposed to view.
Figure 2:
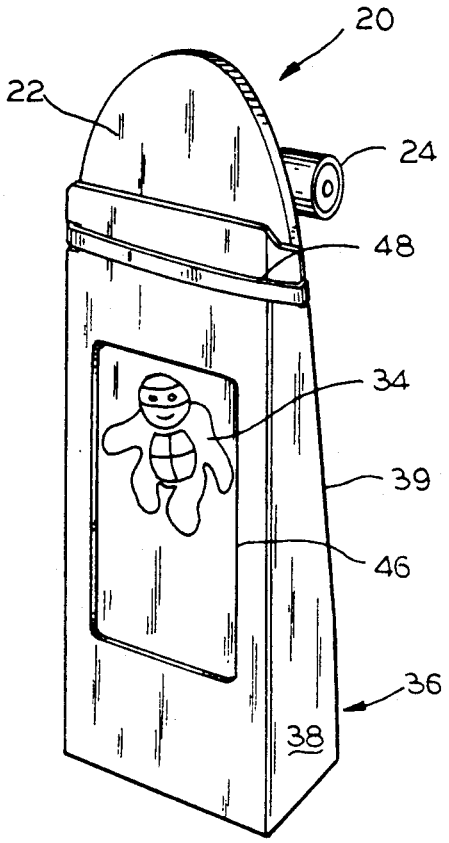
FIG. 2 is a similar perspective view of the opposite (non-wheel) side of the skateboard with graphics on the top of the board exposed to view.
Figure 3:
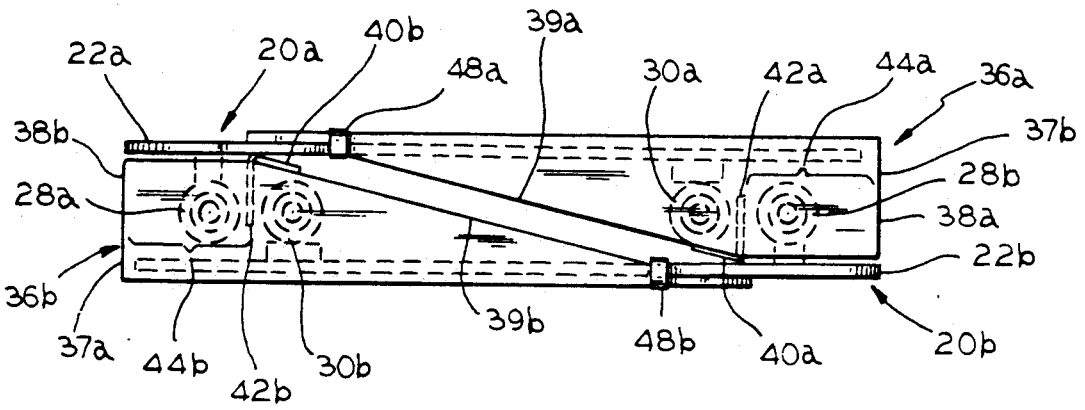
FIG. 3 is a side view, partially in phantom, showing two boxed skateboards nested together.

In FIGS. 1–3, a skateboard 20 comprises a board 21 having front and back wheels 24, 26, 28, 30 attached thereto. The board 21 has a conventional shape, with graphics 32 on the bottom surface (the wheeled side) and other graphics 34 on the top surface (the non-wheeled side).

The inventive box 36 has one squared end 37 at the rear (or bottom in FIG. 1) and a front tip end 35. The forward end 22 of the board 21 is exposed past the front tip end 35 of the box 36. The generally trapezoid-shaped adjacent panel 38 between the squared end 37 and board tip is slanted at 39 to permit two of the boxes to rest on each other along the slanted surface, as best seen in FIG. 3.

A reinforcing bar 40 is built into the squared end 37 to provide a surface against which the forward end of another skateboard may rest. Depending from reinforcing bar 40 is a partition wall 42 (FIG. 5) which separates two sets of wheels when two boxes are nested together. The reinforcing bar 40 and partition 42 define a separate compartment 44 for receiving the wheels of another skateboard. The forward end 22 of skateboard 20 projects beyond the box for a distance which is approximately equal to the width of compartment 44.

Graphics 32 on the bottom of the skateboard are clearly visible because, except for reinforcing bar 40, the box is completely open. The opposite side of the box has a window 46 formed therein for exposing graphics 34 on the other side of the skateboard.

A strap or band (preferably plastic) 48 surrounds the skateboard 20 and box to join them at the front tip end 35 of the box. The ends of the band 48 may be heat sealed to join them. The opposite end 23 of the skateboard is firmly held in the box because the rear wheels 26, 30 are entrapped in a pocket under reinforcing bar 40 and in front of the partition 42. That is, the wheels 26, 30 are pushed into the pocket and the forward end 22 of the skateboard and the front tip end 35 of the box are secured together by the band 48. Thereafter, the box and board cannot be separated without cutting the band 48.

FIG. 3 shows two nested box and skateboard combinations. The parts of the upper box and board are further identified by a suffix letter "a" and of the lower box and board by a suffix letter "b".

This figure shows the wheels 28a nesting in compartment 44b and wheels 28b nesting in compartment 44a. The slanting edges 39a and 39b of the adjacent panels 38 permit the two boxes to fit together. The forward end 22 of skateboard projects far enough beyond the end of adjacent panel 38 to cover the compartment 44 on the other box.

Figure 4:
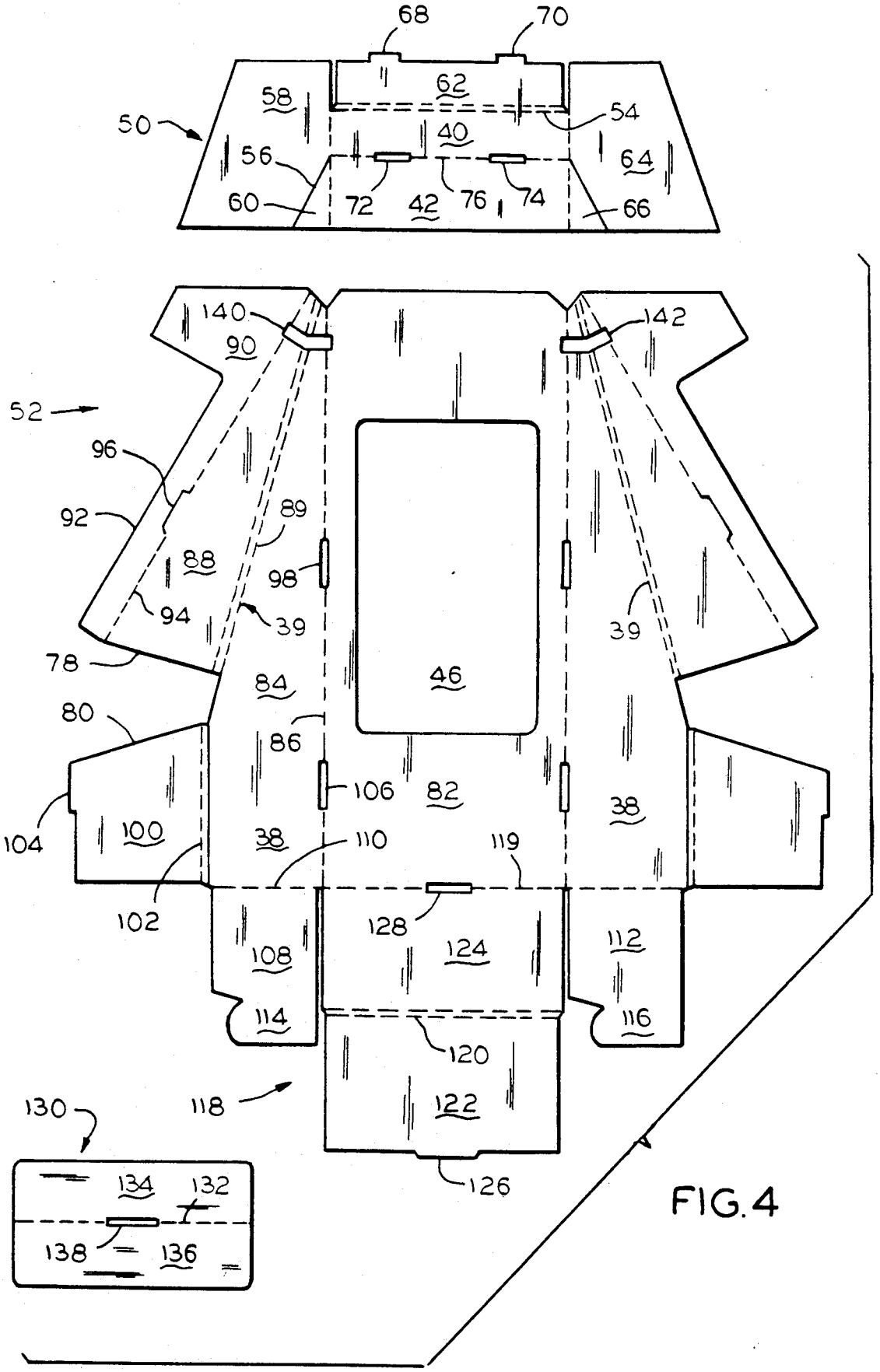
FIG. 4 shows the blanks for a three part box incorporating the invention.

The box is desirably formed from three blanks 50, 52, 130 (FIG. 4). The first and pocket forming blank 50 provides the reinforcing bar 40 and partition 42 which entrap the rear wheels of the skateboard within the box. The blank 52 forms most of the box. The blank 130 reinforces the box in compartment 44. Dashed lines, as shown at 54 in the blank 50, are used to show semi-pierced lines formed by rule dies that periodically pierce the blank to establish fold lines. Solid lines, as shown at 56 in blank 50, are used to show cut lines separating blank panels.

The blank 50 is divided into seven panels 40, 42, 58, 60, 62, 64, 66. There are four anchor panels 58, 60, 64, 66 which are captured behind folded panels of blank 52 (as described subsequently) in order to secure the reinforcing bar and partition 42 in the box. Panel 62 has two projecting locking tabs 68, 70 which are captured in two slots 72, 74 formed along fold line 76 which separates panels 40, 42. Thus, the reinforcing bar actually comprises panel 62 folded along line 54 to come into face to face contact with panel 40 with tabs 68, 70 captured in slots 72, 74 to form a double thickness. The panel 42 folds perpendicularly to the reinforcing bar. The anchor panels 58, 60, 64, 66, also fold to be captured behind edges 78, 80 (on blank 52).

The main box blank 52 has a back panel 82 with window 46 formed therein. The adjacent panels 38 attached to opposite sides of the back panel 82 are mirror images of each other. Therefore, only one side of blank 52 will be described.

The adjacent panel 38 having an exposed side 84 is joined to the back panel 82 by a semi-pierced fold line 86. On the outboard or outside edge of adjacent panel 38 (i.e., most distant from window 46) is a reinforcing side panel 88, which is joined to adjacent panel 38 by a double semi-pierced fold line 89. Beyond the reinforcing side panel 88 is a reinforcing bottom panel 90 defined by a semi-pierced fold line 94 and having a cut out edge 92 which duplicates the contours of the edge of window 46. The fold line 94 has a locking tab 96 cut therein. This tab will fit into a keeper slot 98 formed in fold line 86. When so locked into a position, reinforcing bottom panel 90 lies in flat, face to face contact with the back panel 82, and with the contour 92 juxtaposed over the corresponding edge of window 46.

The wide, base end of the adjacent panel 38 has a capture panel 100 joined thereto by a pair of semi-pierced lines 102. A capture tab 104 is die cut along the outside edge of capture panel 100. Capture tab 104 fits into a keeper slot 106 formed along the fold line 86 after capture panel 100 is folded along line 102 and over the squared end of adjacent panel 84.

The double fold lines 89, 102 provide enough space to receive and capture the anchor panels with panel 62 coming to rest against edge 80.

Means, in the form of end flaps, are provided for holding the sides of the box in an upright spaced parallel relationship. More particularly, a locking flap 108 is attached to the base end (as viewed in FIG. 4) of the adjacent panel by a semi-pierced fold line 110. The locking flap 108 mates with a corresponding locking flap 112 on the opposite side of the box. When the locking flaps 108, 112 come together, two ears 114, 116 fit oVer each other to rigidly join the sides of the box.

End flap 118 is joined to the bottom of back panel 82 by a fold line 119. End flap 118 has a double fold line 120 which divides end flap 118 into an inner part 122 and an outer part 124. A locking tab 126 on the inner part 122 fits into a keeper slot 128 formed in the fold line 119. The double fold line 120 provides enough space to fit over the joined locking flaps 108, 112.

Figure 5:
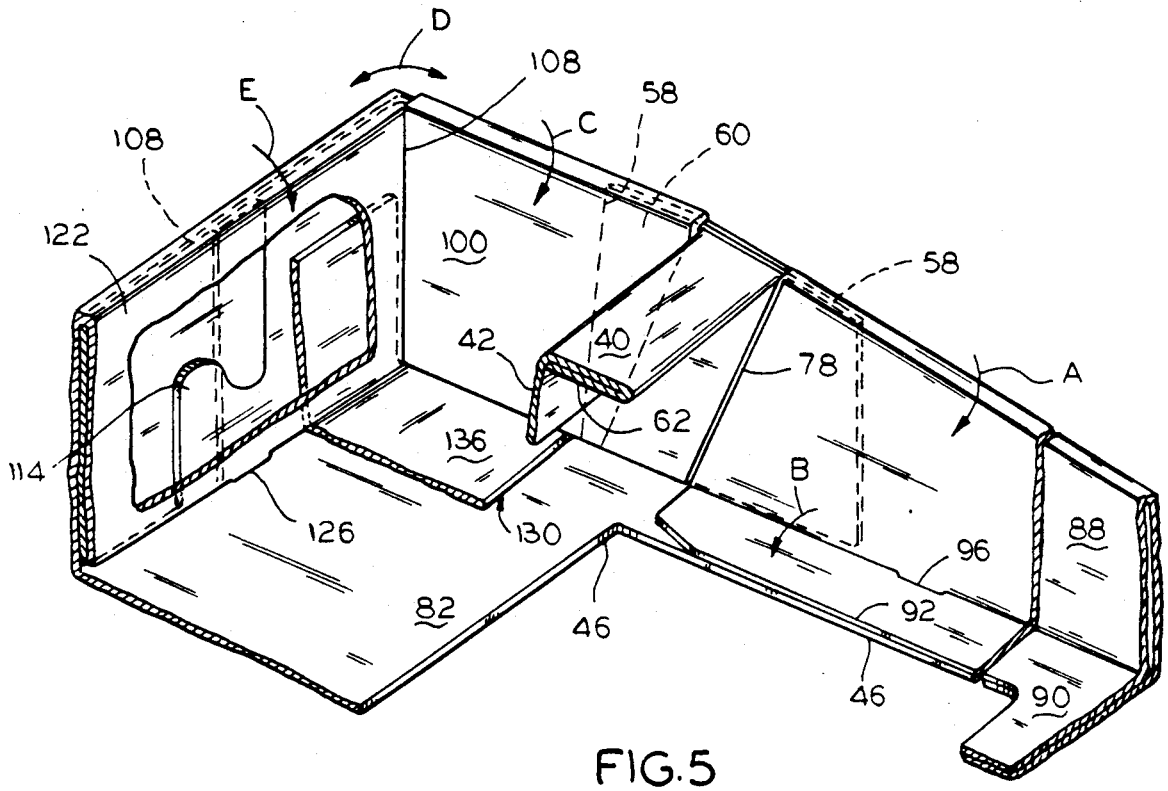
FIG. 5 is a perspective view of a back corner of the inventive box partially in section and partially in phantom.

FIG. 5 is a perspective view of a corner of the box in an assembled condition. The relationship between the panels in the various figures will become apparent by comparing the reference numerals in those figures.

Means are provided for mutually anchoring and capturing blanks 50, 52 to form a composite box. More particularly, to fold the blanks to form the box, the blank 50 is initially folded as a separate part. A triangular anchor panel 60 is bent out at right angles from the partition 42. Tabs 68, 70 are placed in slots 72, 74. Then, the anchor panels 58, 64 are folded over and held against the adjacent panel 84. While so holding the anchor panels 58, 64 in place, the outboard reinforcing side panel 88 is folded over in direction A while the reinforcing bottom panel 90 is folded out in direction B. The capture tab 96 is placed in slot 98.

While continuing to hold the anchor panel 58 in place, and while holding the second anchor panel 60 flat against the side panel 84, capture panel 100 is folded over in direction C. The locking flaps 108, 112 are folded in direction D and ears 114 and 116 are fastened over each other to lock them in place.

A separate piece 130 (FIG. 4) is folded approximately in half and along fold line 132, to provide two panels 134, 136 Which are perpendicular to each other. A cut out portion 138 is placed over the keeper slot 128. End flap 118 is folded in direction E so that panel 122 folds over the joined locking flaps 108, 112 and the panel 134. The tab 126 is fitted through slot 138 and into the keeper slot 128.

Figure 6:
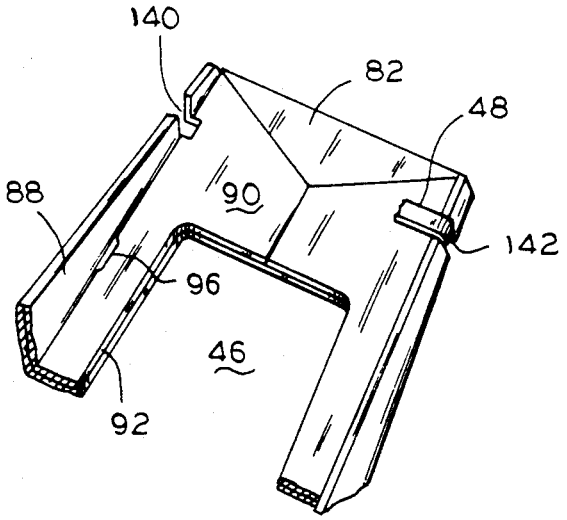
FIG. 6 is a perspective view of the front tip end of the inventive box.

FIG. 6 is a perspective view which shows the tip end of the box. There is a notch or cut out section 140, 142, on each side of the box which forms a strap retaining means. A plastic strap 48 fitting in notches 140, 142 surrounds both the skateboard 20 and the box to join them together for shipping. After the strap is drawn tightly, it is heat bonded into place.

Thus, the inventive box displays a skateboard in an attractive manner while preventing it from being damaged. The graphics on both sides of the skateboard are visible to the purchaser. Two skateboards in their respective boxes can be shipped or stored in a space-efficient manner.

Those who are skilled in the art will readily perceive how to modify the invention. Therefore, the appended claims are to be construed to cover all equivalent structures which fall within the true scope and spirit of the invention.

I claim:

1. A box for a skateboard having a board with a pair of wheels at its forward and rear ends, comprising:

a box with a front tip end, a bottom, two sides adjacent to said bottom, and a squared rear end section;

a partition between said rear end section and said front tip end to form a compartment for receiving the wheels of another skateboard; and means at said front tip end for securing a skateboard to said box, the shape and dimensions of said box being such that two of said boxes fit together with wheels at said forward end of a skateboard in one of said two boxes fitting into the compartment in the squared end of the other of said two boxes.

2. The box of claim wherein said partition has a reinforcing bar associated therewith to form a pocket for entrapping rear wheels of a skateboard packed in said box, said entrapped wheels being between said reinforcing bar and said front tip end.

3. The box of claim 1 and window means in said bottom of said box for displaying graphics on said skateboard.

4. The box of claim 1 wherein said skateboard securing means extend from one adjacent side to the other adjacent side and across said skateboard.

5. The box of claim 1 wherein said adjacent sides extend from said squared rear end section to a point on said skateboard which leaves a forward end of said skateboard projecting beyond said box for a distance approximately equal to the width of said compartment.

6. A skateboard box, comprising:

a first blank having a back panel, adjacent panels integrally attached to opposite sides of said back panel, a reinforcing side panel attached to each of said adjacent panels for folding over said adjacent panel and locking to said back panel, a capture panel integrally attached to each of said adjacent panels, and end panels for securing said side panels in an upright spaced parallel relationship; and a second blank for folding to form a member to capture the rear wheels of a skateboard, said second blank having a pair of anchor panels for capture behind said reinforcing side panels and said capture panels of said first blank.

7. The box of claim 6 and a window in said back panel for displaying said skateboard.

8. The box of claim 7 wherein said first blank has reinforcing bottom panels coupled to an outside edge of said reinforcing side panels, said reinforcing bottom panels having contours which coincide with contours of at least a part of said window in said back panel.

9. The box of claim 6 wherein said second blank comprises three integrally joined center panels, each of said center panels having a width approximately equal to a width of said back panel, two of said three panels folding over each other in a face to face relationship to form a reinforcing bar, the third of said three panels extending perpendicularly from said reinforcing bar toward said back panel for forming a pocket channel for entrapping rear wheels on a skateboard.

10. The box of claim 6 and notches formed in the front of said box for capturing a bonding strap used to secure a skateboard in said box.

11. A skateboard box formed from at least two blanks, a first of said blanks folding to form a box having a generally trapezoidal cross-section, said first blank being an integral member comprising a back panel having generally trapezoidal side panels and end flaps which fold to form said rear of said box, a second of said blanks having a plurality of panels which fold to form a pocket with a reinforcing bar for entrapping rear wheels on said skateboard, panels on said first and second blanks for anchoring and capturing said two blanks with respect to each other to form a composite box, said composite box having a compartment defined by said reinforcing bar and the rear of said box, means for securing a skateboard in said composite box by capturing it near the front of said box, said box having dimensions and a size such that two skateboard boxes may be nested in an inverted relationship relative to each other with each skateboard having front wheels which fit into the compartment in the box of the other skateboard.

12. The skateboard box of claim 11 which is short enough in length so that the front end of each skateboard projects beyond the box far enough to cover the compartment of the other box when said boxes are nested.

* * * * *